US005606964A

United States Patent [19]

Bussman

[11] Patent Number: 5,606,964

[45] Date of Patent: Mar. 4, 1997

[54] PORTABLE POOL HEATER

[76] Inventor: Hans T. Bussman, 816 Park Ave., Hoboken, N.J. 07030

[21] Appl. No.: 525,961

[22] Filed: Sep. 8, 1995

[51] Int. Cl.[6] ..... F24H 1/00

[52] U.S. Cl. ..... 126/350 R; 122/356; 122/14

[58] Field of Search ..... 126/350 R, 361, 126/362; 122/13.1, 14, 250 R, 265, 356

[56] References Cited

U.S. PATENT DOCUMENTS

| | | | |
|---|---|---|---|
| 2,348,610 | 5/1944 | Colby | 122/356 |
| 4,644,904 | 2/1987 | Metz | 126/350 R |
| 5,201,307 | 3/1993 | Afshar | 126/350 R |
| 5,347,957 | 9/1994 | Sugahara | 126/361 |

*Primary Examiner*—Carroll B. Dority
*Attorney, Agent, or Firm*—Darby & Darby, P.C.

[57] ABSTRACT

A heater for liquids having a pump that receives the liquid to be heated includes a burner for producing heat output. A primary heating coil has an inlet for receiving the liquid to be heated from the pump and an outlet. The primary heating coil is located above the burner to receive heat output and a secondary heating coil having an inlet is positioned above the primary heating coil to receive burner heat output. The secondary heating coil receives heated liquid from the primary coil outlet for further heating to produce the final heated liquid at its outlet. A conduit recirculates heated liquid from said secondary heating coil back to the pump inlet to mix with the liquid applied to the inlet to raise the temperature of the liquid supplied to the primary heating coil.

12 Claims, 2 Drawing Sheets

PORTABLE POOL HEATER

FIELD OF THE INVENTION

The invention relates to a heater for liquids, such as water, that has high efficiency and can be portable.

BACKGROUND OF THE INVENTION

A need exists for a heater than can heat large quantities of water that is relatively inexpensive in its construction and has good efficiency to reduce the costs of fuel for the heater and increase the speed of heating. One application for such a heater is for use with swimming pools of the inground or above ground type. An efficient heater permits the owner of the pool to extend its time of use when the weather turns cold.

Swimming pools have a large volume of water. For example, a mid-size above ground pool of 30' by 15' holds about 30,000 gallons. The heat required to heat the pool water to a usable temperature, usually about 85°, is a function of the water volume as well as the ambient temperature, the original temperature of the pool water and the desired final temperature. It is desired to perform the heating process in as short a time period as possible and at the minimum cost for fuel.

Heretofore, heaters such as for swimming pools have been provided which use electrical or gas fired heating elements. Such heaters are, in general, relatively inefficient. They are usually fixed in place and require a relatively long period of time to heat the water from an initial cool/cold temperature, where there basically has been no prior heating of the water and the ambient temperature is low, to one that is acceptable to the user. A fixed heater cannot be easily used with above ground pools, or used with different pools. Also, often it requires that a special housing be constructed for the heater.

Portable heaters have been used. In general, the available portable heaters have been relatively inefficient. The inefficiency results from a variety of factors such as, for example, excessive condensation as the cool water is being heated and a layout of the parts that does not result in maximum utilization of the heat from the source.

BRIEF DESCRIPTION OF THE INVENTION

The present invention relates to a heater for a liquid, such as water, which is highly efficient and is of relatively simple construction.

In accordance with the invention, the heater receives the liquid to be heated, from a source, such as water from an above-ground swimming pool. The water is applied to a pump which moves it to a primary heating coil located above a set of burners. The primary coil is a set of layers of tubes arranged in a serpentine pattern and placed at an angle relative to the horizontal so that condensation can drip off the tubes of the primary coil in a controlled manner.

The heated water is conveyed from the primary coil to a secondary coil disposed above the primary coil. The secondary coil is in a horizontal plane disposed above the primary coil and in the path to receive heat from the burner. The heated water output of the secondary heating coil is supplied back to the source.

A branch conduit is provided between the secondary heating coil output to recirculate an amount of the heated water back to the input of the pump. This raises the temperature of the water supplied to the primary heating coil and reduces condensation on its tubes by raising the temperature to the water supplied to the primary coil.

The heater is compact and can be mounted on a carriage or trolley for movement. It is efficient and can operate from a portable gas supply or a fixed supply main.

OBJECTS OF THE INVENTION

It is an object of the invention to provide a heater for liquids, such as water, that is efficient and can heat a large volume of water in an efficient manner.

Another object provides a heater for a liquid in which a primary and a secondary heating coil are disposed above each other and a burner in the same direct transfer path of the heat from the burner.

Still a further object is to provide a heater having multi-stages for a liquid in which a part of the heated water at the heater outlet is supplied back to its inlet to reduce the temperature rise of the heating in the first stage of the heater.

Yet another object is to provide a heater having primary and secondary heating coils in which water to be heated is provided to the inlet of the primary heating coil and then to a secondary coil for final heating, with a portion of the heated water from the outlet of the secondary coil supplied back to the inlet of the primary coil.

DETAILED DESCRIPTION OF THE INVENTION

Figure 1:
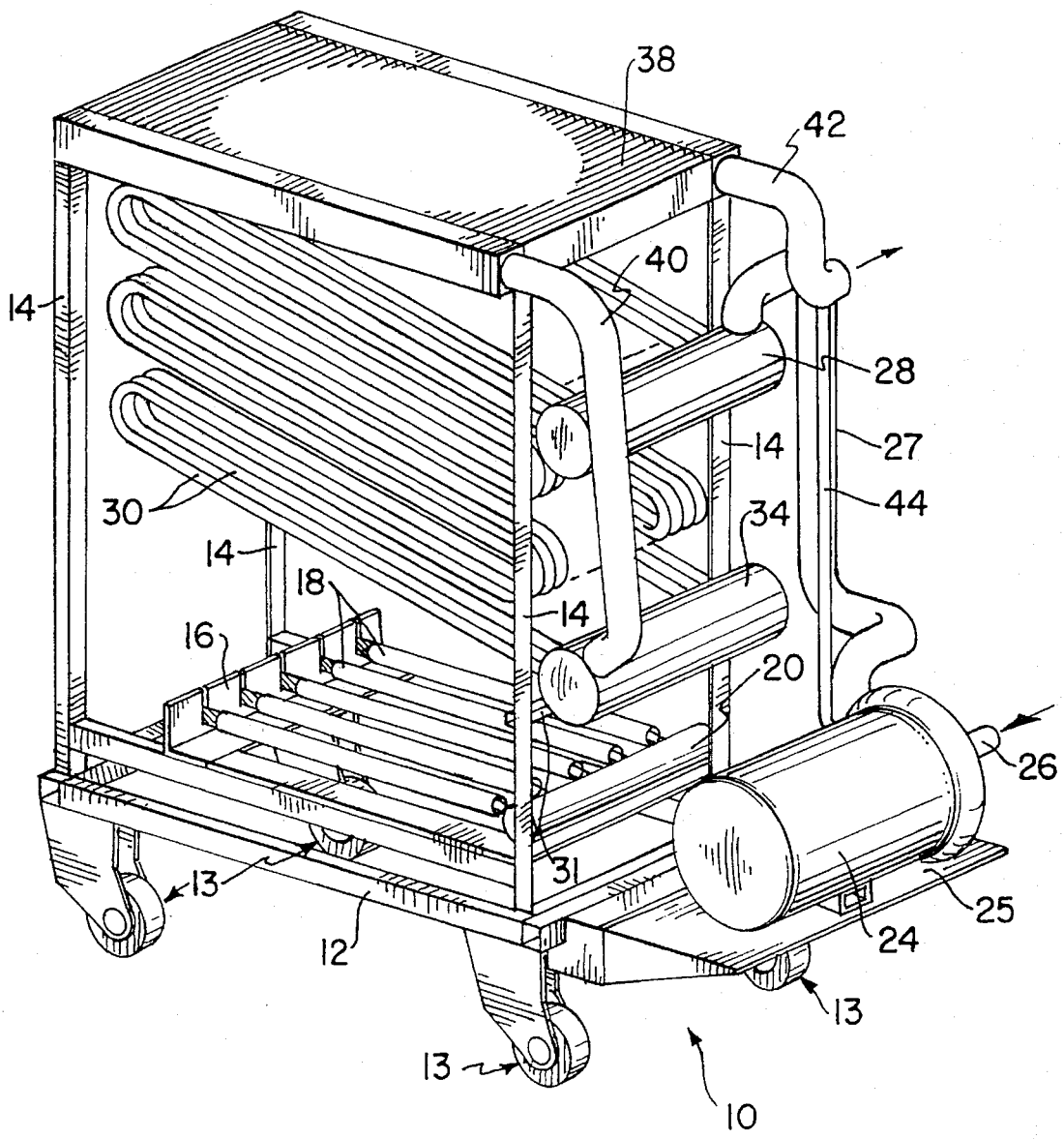
FIG. 1 is a front perspective view of the heater of the invention.
Figure 2:
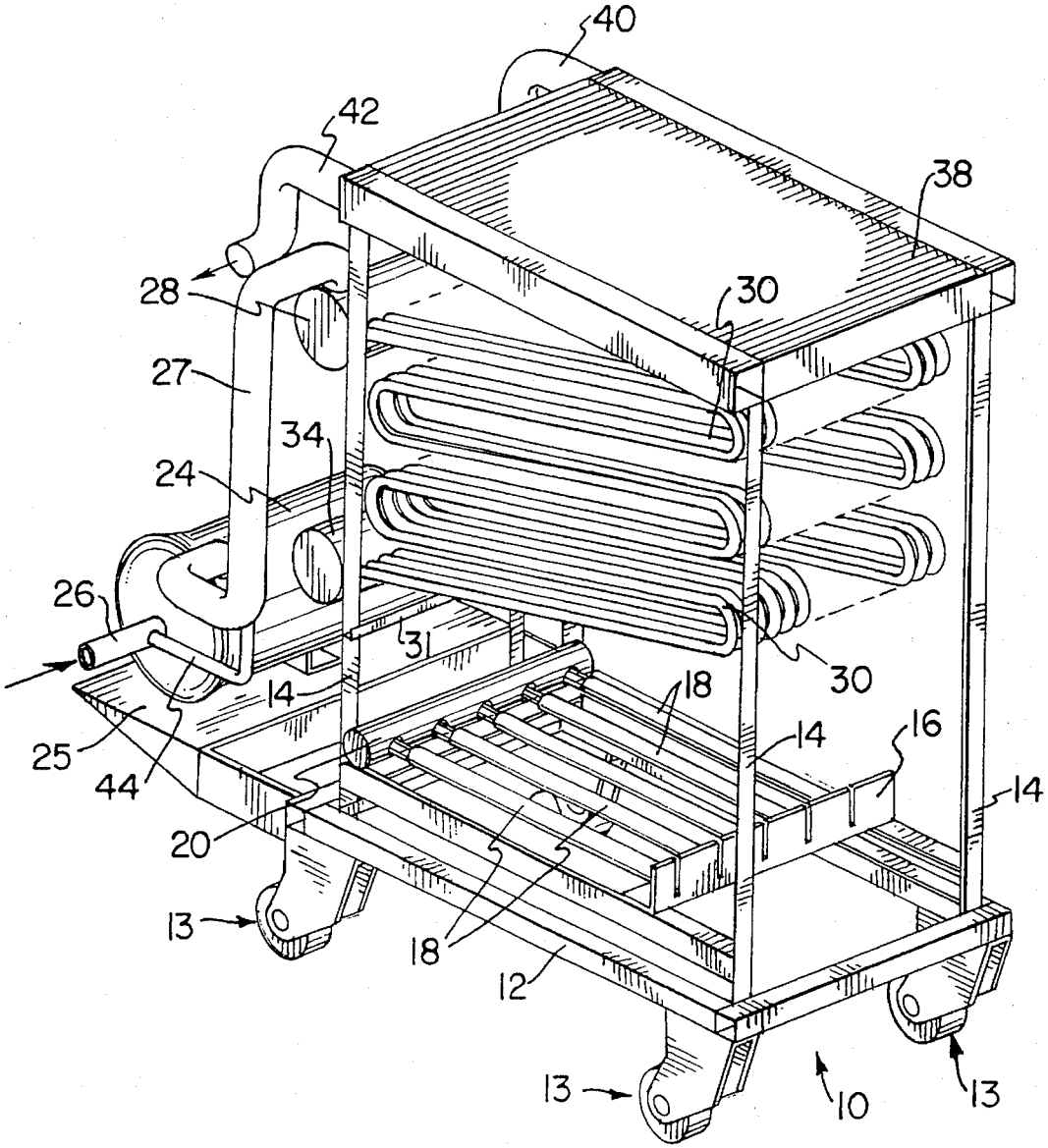
FIG. 2 is a rear perspective view of the heater.

Referring to the drawings, the heater is illustratively shown as being in portable form, although it can be made a fixed unit. As shown it includes a carriage 10 having a base 12 and vertical supports 14. The base 12 has a suitable caster assembly 13 mounted at the corners to permit the carriage to be moved.

A flame burner rack 16 is mounted on the carriage bottom 12 and carries a number of parallel mounted burners 18. One end of each of these burners is connected to a manifold 20 which is fed from the suitable gas supply source (not shown). The gas supply can be a separate tank or a city-type gas main. The number and size of the burners 18 is selected to correspond with the capacity of the heater. The array of burners as shown produces a generally rectangular source with uniform heat distribution for the upwardly flowing heat.

Mounted to the vertical supports 14 is an extension 25 of the carriage base which supports a pump 24 of a suitable capacity. Pump 24 has an inlet 26 for the water to be heated. The water can be, for example, from a swimming pool of either the in-ground or above-ground type. The pump 24 is electrically operated and has the necessary electrical connections (not shown) made in a code approved manner.

Pump 24 has an upwardly extending outlet 27 which is connected to an inlet header 28 of a primary heating coil 30. The primary heater coil 30 is mounted above burner rack 16 to receive heated exhaust from the burners 18. Primary coil 30 is formed by a plurality of tubes each having an inlet end connected to the header 28. The tubes are spaced apart generally parallel to each other and are formed as serpentine layers, six such layers being shown. As many tubes and layers as needed can be used and the size of the tubes is selected according to the heater capacity. The tubes in the rows of adjacent layers are staggered with spaces relative to the rows of tubes in the layers above and below it so that heat from burner 16 can more easily pass to all layers of the primary coil. The outlet ends of the tubes forming the primary coil are connected to an outlet header 34. Below the coil 30 across the carriage vertical supports 14 is a catch tray 31 to receive condensation that drips off of the primary heating coil.

The heater primary coil 30 is mounted between the front and rear vertical supports 14 at an angle, preferably about 12° relative to the horizontal. A conduit (not shown) can empty the water from the catch tray.

A secondary heater coil 38 is mounted generally horizontally above the primary heater coil 30 at the top ends of the vertical supports 14. The inlet to the secondary heating coil 38 is from the primary heating coil outlet header 34 through a conduit 40. The secondary heating coil 38 is shown as being of the finned radiator type, such as in found in autos, and has an outlet of 42 for the heated water. The secondary coil 38 receives heat from burner 16 passing through the spaces between the tubes of the primary coil 30.

Branching from the outlet 42 of the secondary heating coil 38 is a recirculating conduit 44. The recirculating content supplies heated water back to the inlet of pump 24. A valve can be provided in conduit 44, if desired, to control the amount of heated water supplied back to the pump inlet. Also, if desired, the valve can be controlled as a function of the temperature of the water at the pump outlet.

The operation of the heater is as follows. The cold water from the source, such as a swimming pool, to be heated enters the pump 24 through inlet 26. It is pumped upwardly through the tubing 27 to the inlet header 28 of the primary heating coil 30. Heated exhaust from the burners 18 travels upwardly to the layers of the primary heating coil to heat the water supplied by the pump 24. The heat also passes through the spaces in the layers of the primary heating coil 30 to the secondary heating coil 38.

The primary heating coil acts as a heat pump using the heat from the burners as a secondary fluid. The primary heating coil is configured in such a way that a maximum condensation process occurs. In effect, the primary coil 30 is a condenser that condenses super heated water vapor in the exhaust. This allows the water from the source to absorb the large amount of heat released through the condensing process. The primary coil is configured such that the majority of the forming condensate will be removed by flowing downwardly at the angle of the coil, typically 12°, until it reaches the header side 34 and accumulates in the catch tray 31. Condensation that is not re-boiled to start the process all over again will be removed by flowing it through a tube (not shown) connected to the catch tray to outside of the unit.

The heated water exits the primary coil 26 to the outlet header 34. From there the heated water flows from the outlet header 34 over tubing 40 into the secondary heating coil 38. At this time, the water has been pre-heated to approximately one-half of the final heated discharge temperature, i.e., one-half of the difference between the temperature of the water at the primary pump inlet 26 and the water at the heated outlet 42. The water from the primary heating coil discharge header 34 passes through the secondary coil 38 and absorbs heat directly through dry heat contact from the heat produced by the burner assembly 18.

The amount of condensation in the primary coil can be controlled by the heated water supplied back to the pump inlet 26 through the recirculation line 44. Cold new water from the source will mix with the heated recirculation water from the secondary heating coil 38. This effectively preheats the water entering the system and results in reduced condensation being generated in the primary coil 30. The condensation control process can be varied by throttling the amount of water recirculated from the secondary heating coil back to the pump to mix with the hew water from the source.

Test results have shown that the humidity percentage between the exhaust space between the bottom of the primary heating coil and the top of the burner assembly, and between the top of the primary coil 30 and the bottom of the secondary coil 38 humidity percentage is lowered enough, respectively, sufficient to consider any negligible condensing in the secondary heating coil. This results in minimal (if any) condensing occurring in the secondary coil.

All of the components in the system are sized to accommodate the amount of water that is to be heated and the desired temperature rise between the input cold water and the output heated water. These include, for example, the number of burners and the BTU output of such burners, the space between the burners and the primary and secondary heating coils, the space between the primary and secondary heating coils, and the size and volumetric capacity of the coils. Also, the materials selected for the various components are those which will be compatible with water, particularly any chemical content in the water.

In accordance with the invention it is preferred that the entire heater be closed within a suitable housing (not shown). The space between the components in the outer housing has a suitable insulation material.

In an application of the heater in the subject invention, a unit was designed to heat water from an above ground swimming pool having a capacity of 10,000 gallons. The water in the pool was at a temperature of 63.2° F. and it was to be heated to 83.00° F. The ambient temperature was 68° F.

In the above unit, the water in the pool was heated to the desired output temperature in about 4.12 hours. The cost of the gas used as the fuel was $20.00 based on a cost of $.50/lb. of propane (2 tanks), which produced approximately 250,000 BTUs/hr.

If desired, the heater can be under the control of the temperature of the water in the source from which the water is taken and returned. For example, a thermostat can measure the water temperature in the location to which the heated water is returned. When a desired temperature is reached, the thermostat sends a signal to turn off the pump and the burner.

I claim:

1. A heater for liquids comprising:

a burner for producing heat output;

a primary heating coil having an inlet for receiving the liquid to be heated and an outlet, said primary heating coil located above said burner to receive burner heat output;

a secondary heating coil having an inlet and an outlet positioned above said burner to receive burner heat output, said secondary heating coil inlet receiving heated liquid from said primary coil outlet for further heating by the heat from the burner to produce the heated liquid at the second heating coil outlet; and a conduit for re-circulating heated liquid from said secondary heating coil to mix with the liquid applied to the inlet of said primary heating coil.

2. A heater as in claim 1 further comprising a pump having an inlet and an outlet, said pump receiving the liquid to be heated at its inlet and pumping it from its outlet to the inlet of said primary heating coil.

3. A heater as in claim 2 wherein the conduit for recirculating supplies heated liquid from the secondary heating coil outlet to the inlet of the pump.

4. A heater as in claim 1 wherein said primary heating coil comprises serpentine layers of heating coils arranged at an angle relative to the horizontal.

5. A heater as in claim 4 wherein each layer of said primary heating coil comprises a plurality of tubes having inputs connected in parallel to a header with the tubes of each layer offset from the tubes of the layers above and below it to permit passage of heat through the spaces between the tubes.

6. A heater as in claim 4 wherein said angle is about 12°.

7. A heater as in claim 5 further comprising a drip pan below said primary heating coil to collect condensation dripping from said primary heating coil.

8. A heater as in claim 4 wherein said secondary heating coil is disposed above said primary heating coil.

9. A heater as in claim 8 wherein said secondary heating coil is a finned type radiator.

10. A heater as in claim 8 wherein said secondary heating coil is disposed substantially horizontal and said primary heating coil is at an angle of about 12° with respect to the horizontal.

11. A heater as in claim 4 further comprising an inlet header at the inlet to said primary heating coil that receives the liquid to be heated, the inlets of all of the coils of said primary heating coil receiving liquid from the inlet header.

12. A heater as in claim 11 further comprising an outlet header to which the outlets of all of the coils of the primary heating coil are connected, said primary heating coil outlet header having an outlet to supply heated liquid to said secondary heating coil.

* * * * *